United States Patent [19]

Sos et al.

[11] Patent Number: 4,817,398

[45] Date of Patent: Apr. 4, 1989

[54] LATCH NEEDLE FOR LOOP FORMING TEXTILE MACHINES

[75] Inventors: Sigmund Sos; Ferdinand Schuller, both of Albstadt, Fed. Rep. of Germany

[73] Assignee: Theodor Groz & Söhne & Ernst Beckert Nadelfabrik Commandit-Gesellschaft, Albstadt-Ebingen, Fed. Rep. of Germany

[21] Appl. No.: 191,031

[22] Filed: May 6, 1988

[30] Foreign Application Priority Data

May 7, 1987 [DE] Fed. Rep. of Germany ... 8706529[U]

[51] Int. Cl.[4] ..... D04B 35/04

[52] U.S. Cl. ..... 66/121; 66/122

[58] Field of Search ..... 66/121, 122, 116

[56] References Cited

U.S. PATENT DOCUMENTS 4,294,086 10/1981 Mayer et al. .
4,601,180 7/1986 Mayer et al. .
4,781,040 11/1988 Kolke ..... 66/121

FOREIGN PATENT DOCUMENTS 1026914 3/1958 Fed. Rep. of Germany ..... 66/121
1046819 12/1958 Fed. Rep. of Germany .

*Primary Examiner*—Ronald Feldbaum
*Attorney, Agent, or Firm*—Spencer & Frank

[57] ABSTRACT

A latch needle for loop forming textile machines includes a steel needle shank and a nonmetallic latch. The steel needle shank has upper and lower edges, a sawslot defined in the needle shank and a needle hook at one end of the needle shank. The needle also includes an axle which extends transversely across the sawslot and contacts the needle shank. The latch is pivotally mounted on the axle and is provided with a noucat at one end. The latch is pivotal between an open and a closed position. When the latch is in the closed position, the noucat rests on the needle hook and when the latch is in the open position, the back surface of the latch contacts part of the needle shank. The nonmetallic material which the latch is composed of is a fiber reinforced thermoplastic homopolymer or copolymer plastic.

8 Claims, 2 Drawing Sheets

LATCH NEEDLE FOR LOOP FORMING TEXTILE MACHINES

BACKGROUND OF THE INVENTION

1. Field of the Invention

The present invention relates to a latch needle for loop forming textile machines. The needle includes a steel needle shank that is equipped with a needle hook at one end of the shank and a sawslot defined in the needle shank. The needle also includes a latch pivotally mounted in the sawslot so that it is pivotal about a transversely extending axle. The latch is pivotal between an open position and a closed position. In the closed position, the noucat (also called the latch spoon) rests on the needle hook and in the fully open position, the back surface of the latch rests on contact surfaces in the region of the upper edge of the needle shank.

In high speed loop forming textile machines, such as circular knitting machines, the latches of the latch needles are subjected to very high stresses. Because these latch needles are currently oscillated between the closed position and the fully open position at a frequency of 60 Hz or more, high acceleration and deceleration forces act on the latch. These forces not only subject the latch to bending stresses but also force the contact surfaces provided on the needle shank to absorb energy when the noucat impacts the hook or the back of the latch impacts on the shank. This energy must be absorbed by the shank or hook by elastic bending deformation and must be dissipated by friction. As a consequence of these high stresses exerted on the needle, not only may the noucat and the hook be damaged, but the latch may break and the latch bearing and/or the needle shank may be damaged.

2. Discussion of the Prior Art

Various different solutions have been proposed in the prior art to avoid the possible damage described above. For example, German Pat. No. 2,714,607 (to which corresponds U.S. Pat. No. 4,294,086) discloses a special configuration of the needle sawslot to elastically absorb the impact of the latch in the fully open or standing position. However, while this is an effective measure for absorbing the impact of the back of the latch as it contacts the shank, it is unable to influence or reduce the undamped impact of the latch noucat on the needle hook.

German Pat. No. 3,331,031 (to which corresponds U.S. Pat. No. 4,601,180) discloses a latch needle where the latch has at least one continuous recess in the region between the bearing bore and the noucat. This results in a reduction of mass which reduces the acceleration and deceleration forces generated by the pivoting movement of the latch. This also reduces the impact energy of the noucat on the needle hook as well as the impact energy of the back of the latch on the respective contact surfaces of the needle shank. However, due to the minute dimensions involved in latches for very fine or thin needles, the making of these recesses involves considerable expense.

German Pat. No. 1,046,819 discloses a latch needle that is particularly adapted for home (manual) knitting machines. The latch is made of a non-magnetizable material such as beryllium bronze or a synthetic compressed substance. This reference claims that by using a non-magnetizable material for part of the needle head and particularly for the latch, the latch will not stick to the hook as a result of remanent magnetism. The problem of the latch sticking to the hook due to magnetism occasionally occurred in latch needles made uniformly of magnetizable steel and utilized in home knitting machines. However, this problem does not occur in latch needles used in industrial machines. Moreover, latches made of beryllium bronze or of a compressed substance are unable to withstand the long-term stresses that they are subjected to in high speed circular knitting machines.

SUMMARY OF THE INVENTION

It is an object of the present invention to provide a latch needle suitable for high speed machines where the needle is able to absorb, without damage, the stresses which occur when the noucat impacts on the hook and the back of the latch impacts on the contact surfaces of the needle shank while simultaneously avoiding damage to the hook and to the needle shank.

The above and other objects are accomplished by the invention according to which the needle latch is made of a fiber reinforced thermoplastic homopolymer or copolymer plastic.

Examples of suitable plastics are polyurethane and polyamides.

Polyacetal (Copolymer)

Compared with steels, non-metals and pressed substances, these plastics have significantly improved damping characteristics. These plastics also have an elasticity behavior which is particularly suited for the present application. The fiber reinforcement increases the bending strength of the synthetic material such that the latch is able to withstand the mechanical stresses which occur therein even over long periods of operation. A saving in weight of about 65% compared to prior art steel latches results because of the correspondingly reduced mass inertia. Thus the impact energy released when the latch impacts on the hook or the contact surfaces is reduced.

The latch can be manufactured by precision microscopic injection molding. This allows a balanced distribution of mass within the latch to be easily achieved.

To facilitate installation of the latch, the latch may be provided with an axle insertion slot which connects the outside surface of the latch with the bearing bore of the latch. This insertion slot is laterally bounded by elastically deformable latch regions. This allows the installation of the axle in the needle shank before the latch is installed. After the axle is installed the latch may be installed by simply clipping it to the axle.

The latch may also be formed with a recess at the edge surface where the insertion slot is located. This recess further facilitates the installation of the latch onto the axle. In cases where a danger exists because the elastic limits of expansion of the elastically yielding latch regions may be exceeded, the latch may be provided with at least one stress-relief slot which begins at the bearing bore and enlarges the length of the elastically deformable latch regions. This is particularly useful for larger latches which may have this problem. Advantageously, the stress relief slot may end in a recess in the latch blade so that the occurrence of an undesirable tear or notch effect at this location is avoided. It has been found that a preferable form of this recess is a circular bore hole.

Advantageously, the insertion slot may be disposed on the side opposite the noucat in a position that is approximately in the center plane of the latch. However, other locations of the insertion slot are also conceivable. For example, the insertion slot may be disposed with one end located on the back or at the front of the latch.

Since the latch is produced by a precision microscopic injection molding process, it is not only possible to ensure a high quality bearing bore but it is also easy to form various parts on the latch itself which would be difficult by a mechanical manufacturing process such as punching. Thus, it is feasible to rigidly affix the latch to the axle or pin journalling in the shank, by means of non-cylindrical zones of the bearing bore.

DESCRIPTION OF THE PREFERRED EMBODIMENTS

Figure 1:
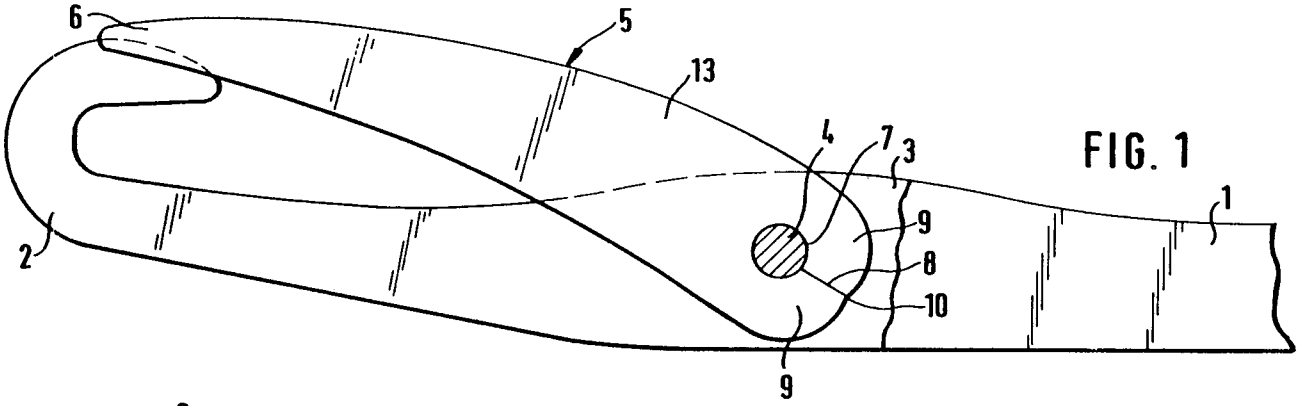
FIG. 1 shows a detailed side view, partially in section, of a latch needle according to a first preferred embodiment of the present invention.
Figure 2:
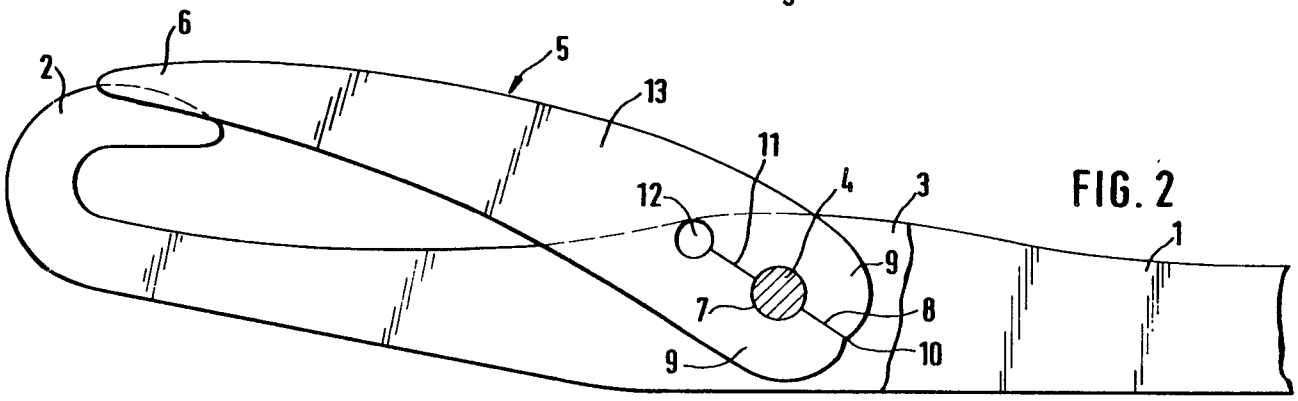
FIG. 2 shows a detailed side view, partially in section, of a latch needle according to a second preferred embodiment of the present invention.

FIGS. 1 and 2 disclose a latch needle having a needle shank 1 equipped with a needle hook 2 at one end and a sawslot 3 disposed therein. The sawslot 3 is disposed symmetrically to the longitudinal center plane of the needle shank 1. A transversely extending cylindrical pin or axle 4 is mounted in the jaws of the needle shank 1 which border both sides of sawslot 3. The axle 4 may be made of one or two pieces and may be inserted into the corresponding bores of the jaws bordering the sawslot 3 or it may be pressed out of these jaws.

A latch 5 is pivotally mounted in sawslot 3 on axle 4. In the closed position the noucat 6 rests on needle hook 2, while in the open position the back of the shank rests on the contact surfaces in the region of the upper edge of needle shank 1. Latch 5 is made of a fiber reinforced, homopolymer or copolymer plastic. Two examples of such a synthetic material are polyurethane and polyamide. The fiber reinforcement may be composed of organic or inorganic fibers, such as glass fibers or carbon fibers. The fibers may be mixed with the plastic but it is also possible to orient the fibers in a particular direction, for example, in the longitudinal direction of the latch 5. The latch 5 is preferably produced by precision microscopic injection molding.

At the end opposite the noucat 6 the latch 5 is provided with a transversely extending bearing bore 7 which, in FIGS. 1 and 2, is cylindrical and is mounted with a close fit on the cylindrical axle 4 for pivotal motion thereabout. An insertion slot 8 is disposed in the latch 5 and opens laterally into bearing bore 7 and extends to the outer surface of latch 5. The insertion slot 8 is laterally bounded on each side by elastically deformable latch regions 9. Insertion slot 8 may also start at an edge recess 10 which is disposed in the outer surface of latch 5. The edge recess helps to facilitate installation of the latch 5 and is preferably disposed on the side opposite noucat 6, approximately in the center plane of the latch.

In the embodiment according to FIG. 2, insertion slot 8 is extended on the opposite side of the bearing bore 7 by a stress-relief slot 11 which enlarges the length of the elastically deformable latch regions 9. Stress-relief slot 11 may also open at its end into a throughgoing cylindrical bore in latch blade 13.

When manufacturing the latch needle, the axle 4 may first be inserted into the needle shank 1. Then the edge recess 10 of latch 5 is aligned with the rivet 4 so that with a slight pressure exerted on the latch 5, the elastically deformable latch regions 9 separate and the axle 4 can then move along the insertion slot 8 until the axle 4 comes to rest in the bearing bore 7. As soon as the axle 4 fits into the bearing bore 7, the latch regions 9 snap together, whereupon the latch 5 is pivotally held on the axle 4.

The embodiment shown in FIG. 1, where the elastically deformable regions 9 extend only to the bearing bore 7, is particularly intended for smaller types of needles which have a correspondingly small axle.

FIG. 2 discloses an embodiment particularly intended for needles which have larger dimensions. The stress-relief slot 11 allows an extension of the length of the elastically deformable latch regions 9 so that there are no risks that the latch regions 9 will be permanently plastically deformed during installation of the latch 5, even if the axle 4 has a large diameter.

Figure 3:
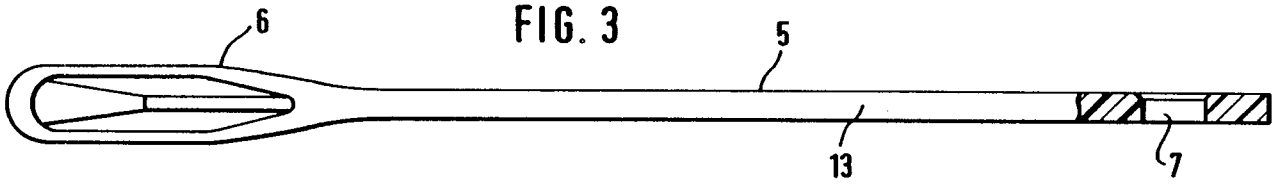
FIG. 3 shows a bottom plan view, partially in section, of the latch of the latch needle according to a third preferred embodiment of the present invention.
Figure 4:
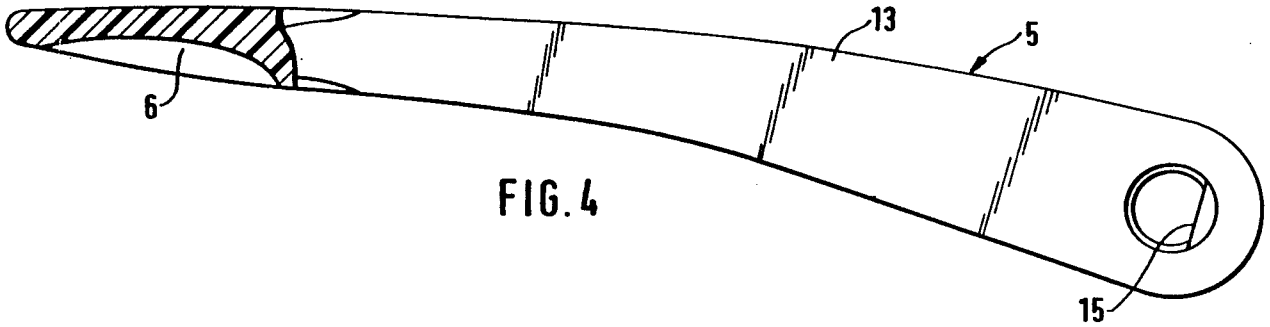
FIG. 4 shows a side view, partially in section, of the latch shown in FIG. 3.

FIGS. 3 and 4 show a slight modification of the details of the latch 5. One of the differences between FIGS. 1 and 2 is that the bearing bore 7 does not have an associated insertion slot 8. Consequently, the latch 5 is mounted in a conventional manner such that the end of latch 5 near the bearing bore 7 is initially introduced into the sawslot 3 whereupon the axle 4 may then be inserted Bearing bore 7 itself may be cylindrical, as shown in FIGS. 1 and 2. In this case, the axle 4 is securely fastened against rotation in the jaws of shank 1 defining the sawslot 3. As an alternative shown in FIG. 4, it is conceivable to shape the latch 5 so that it includes a non-cylindrical portion or face 15 of the bearing bore 7. The latch 5 may then be securely coupled against rotation to a correspondingly profiled axle 4. In this case the axle 4 is rotatably mounted in corresponding bores in the jaws of shank 1.

The present disclosure relates to the subject matter disclosed in German Application No. G 87 06 529.0 of May 7, 1987, the entire specification of which is incorporated herein by reference.

It will be understood that the above description of the present invention is susceptible to various modifications, changes and adaptations, and the same are intended to be comprehended within the meaning and range of equivalents of the appended claims.

What is claimed is:

1. In a latch needle for loop forming textile machines, said needle including:

a steel needle shank having upper and lower edges, a sawslot defined in said needle shank and a needle hook at one end of said needle shank;

an axle extending transversely across said sawslot and supported in said needle shank; and a nonmetallic latch pivotally mounted on said axle and provided with a noucat at one end, said latch being pivotal between an open and a closed position, wherein when said latch is in said closed position, said noucat rests on said needle hook and when said latch is in said open position, a back surface of said latch contacts part of said needle shank, the improvement wherein:

said latch is of a fiber reinforced thermoplastic synthetic material selected from the group consisting of a homopolymer and a copolymer.

2. A latch needle as defined in claim 1, wherein said latch further includes a bearing bore defined therein and an axle insertion slot located between said bearing bore and an outer surface of said latch, said insertion slot being laterally bounded by elastically deformable latch regions of said latch.

3. A latch needle as defined in claim 2, wherein the outer surface of said latch includes a recess defined therein and said insertion slot is located between said recess and said bearing bore.

4. A latch needle as defined in claim 2, wherein said latch further includes at least one stress-relief slot which begins at said bearing bore and extends as a continuation of said insertion slot for increasing the length of said elastically deformable latch regions.

5. A latch needle as defined in claim 4, wherein said latch further includes an aperture disposed therein and said stress-relief slot being disposed between said aperture and said bearing bore.

6. A latch needle as defined in claim 5, wherein said aperture is a throughgoing circular hole.

7. A latch needle as defined in claim 2, wherein said insertion slot is located at an end of said latch opposite said noucat and is disposed approximately in a center plane of said latch.

8. A latch needle as defined in claim 2, wherein said axle is rotatably mounted in said needle shank and said bearing bore includes a non-cylindrical portion for non-rotatably receiving said axle, whereby said latch is rotatable with said axle as a unit.

* * * * *